United States Patent [19]

Brown

[11] Patent Number: 4,763,565

[45] Date of Patent: Aug. 16, 1988

[54] CONVERTIBLE AIR DIFFUSER

[75] Inventor: Douglas S. Brown, Knoxville, Tenn.

[73] Assignee: American Metal Products Company, LaFollette, Tenn.

[21] Appl. No.: 39,517

[22] Filed: Apr. 17, 1987

[51] Int. Cl.[4] ..... F24F 13/062

[52] U.S. Cl. ..... 98/40.13

[58] Field of Search ..... 98/40.05, 40.12, 40.13, 98/40.21, 40.28, 114

[56] References Cited

U.S. PATENT DOCUMENTS

| | | | |
|---|---|---|---|
| 2,467,309 | 4/1949 | Hart et al. | 98/40.28 |
| 2,603,141 | 7/1952 | Phillips et al. | 98/40.21 |
| 2,958,272 | 11/1960 | Titus et al. | 98/40.23 |
| 3,001,056 | 9/1961 | Spear | 98/40.13 X |
| 3,053,164 | 9/1962 | Lyttle et al. | 98/40.13 |
| 3,092,009 | 6/1963 | Goettl . | |
| 3,107,597 | 10/1963 | Person | 98/40.13 |
| 3,217,627 | 11/1965 | Sweeney . | |
| 3,217,628 | 11/1965 | Sweeney et al. . | |
| 3,327,608 | 6/1967 | Newell et al. . | |
| 3,358,577 | 12/1967 | Thomson . | |
| 3,601,034 | 8/1971 | Thorne | 62/110 |
| 4,014,253 | 3/1977 | Dry . | |
| 4,020,752 | 5/1977 | Stephan | 98/114 X |
| 4,352,323 | 10/1982 | Burkarth | 98/40.14 |
| 4,499,815 | 2/1985 | Burkarth | 98/40.14 |

OTHER PUBLICATIONS

"Flexiflo Engineering Manual #34", Flexiflo Universal Diffuser Corp., 38 Marbledale Road, Tuckahoe, N.Y., received Jul. 6, 1959, p. 53.

*Primary Examiner*—Harold Joyce

*Attorney, Agent, or Firm*—Edgar A. Zarins; Steven L. Permut; Leon E. Redman

[57] ABSTRACT

A ceiling air diffuser convertible between a flush-face diffuser with the louvers mounted substantially flush with the ceiling and a drop-down diffuser which provides a more efficient disperison of air flow. By providing this conversion capability, manufacturing and inventory costs are reduced by eliminating duplicity of components for each type of diffuser. The essential component of the drop-down diffuser is a stepped support bracket which is detachably connected to the peripheral frame of the diffuser and to which the directional vanes are mounted. Conversion is accomplished by simply interchanging the removable fin core within the frame member.

10 Claims, 1 Drawing Sheet

CONVERTIBLE AIR DIFFUSER

BACKGROUND OF THE INVENTION

I. Field of the Invention

This invention is directed to an air diffuser adapted to be mounted into the ceiling structure of an interior room and, in particular, to an air diffuser which is readily convertible between a flush-face diffuser and a drop-down diffusr to provide greater air dispersion.

II. Description of the Prior Art

Air conditioning systems for interior structures have long sought efficient circulation of air flow while minimizing energy demands and costs. It is generally acknowledged that ceiling diffusers disperse air more efficiently than wall or floor registers. Since gravity eventually causes the air to flow downwardly away from the ceiling, the efficiency of a ceiling diffuser is measured by the ability of the register to direct the air flow horizontally outward along the ceiling for as great a distance as possible. As the air moves horizontally outward, room air is captured and a blended secondary air motion is created. If the air flow is directed too far downward, less of an area is ventilated requiring a greater number of units or an increase in horsepower.

Although varying in configuration according to the intended placement of the register, ceiling diffusers may be generally classified into two basic types: a flush-face diffuser wherein the face of the diffuser is substantially flush with the ceiling upon installation and a drop-down diffuser wherein the louvers are arranged in a coaxial stepped arrangement extending downwardly from the plane of the ceiling. Although the drop-down diffuser is not acceptable for all interiors because of its protruding structure, it is generally acknowledged that drop-down diffusers provide greater throw and entrainment because air flow may be better directed along the ceiling.

The appropriate diffuser is generally installed during installation of the ceiling according to the specifications of the customer. As a result, if a different diffuser type is thereafter desired or the contractor inadvertently installs the incorrect register, the ceiling installation must be disassembled to remove and replace the entire diffuser. Moreover, despite the use of a substantial number of identical components in both diffuser types, excess inventories must be maintained in order to assemble both types of diffusers thereby increasing manufacturing costs while decreasing efficiency of assembly and installation.

SUMMARY OF THE PRESENT INVENTION

The present invention overcomes the disadvantages of the prior known diffuser constructions by providing a ceiling diffuser which is readily convertible between a flush-face register and a drop-down register by simply replacing the fin core associated with the standard diffuser frame. In addition, by utilizing common components for both types of diffusers inventory and manufacturing costs can be substantially reduced.

The convertible air diffuser generally comprises a square or rectangular frame which includes means for mounting the assembly within the ceiling structure. Secured to the rear of the frame is a damper assembly adapted to shut off or reduce air flow through the diffuser from the ventilation system. The damper may be in the form of an opposed blade damper or a multi-louver assembly. A control member extending through the front face of the frame is utilized to adjust the position of the damper blades. The diffuser frame also includes support brackets extending across the frame to which the designed fin core is mounted. In this manner, both systems utilize a significant number of identical components which decreases inventory and manufacturing costs.

Depending on the specifications of the ventilation system, either a flush-face fin core or a drop-down fin core may be detachably mounted to the diffuser frame. Both fin cores utilize a plurality of similarly configured and axially mounted fin rings. In the case of the flush-face diffuser, the progressively smaller fin rings are mounted to at least one flat bracket member. With the drop-down diffuser, the fin rings are secured to a stepped bracket. Both the flat and the stepped bracket include mounting tabs at the ends thereof which engage slots formed in the interior side wall of the frame. The resiliency of the metal brackets allows removal of the mounting tabs from their corresponding slots in order to remove and replace the fin core.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts through the views, and in which.

DETAILED DESCRIPTION OF A PREFERRED EMBODIMENT OF THE PRESENT INVENTION

Figure 1:
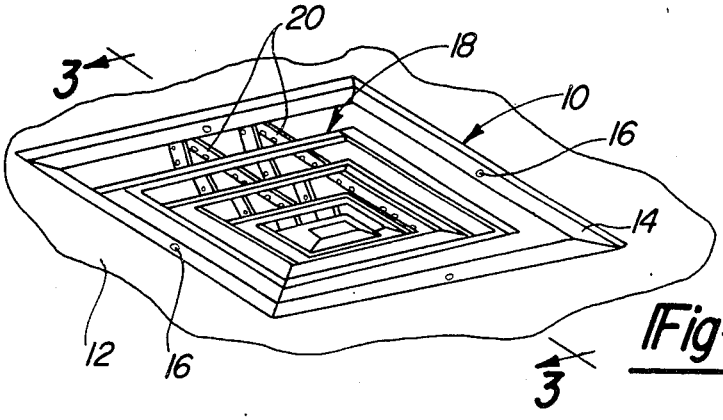
FIG. 1 is a perspective view of the drop-down air diffuser embodying the present invention.
Figure 2:
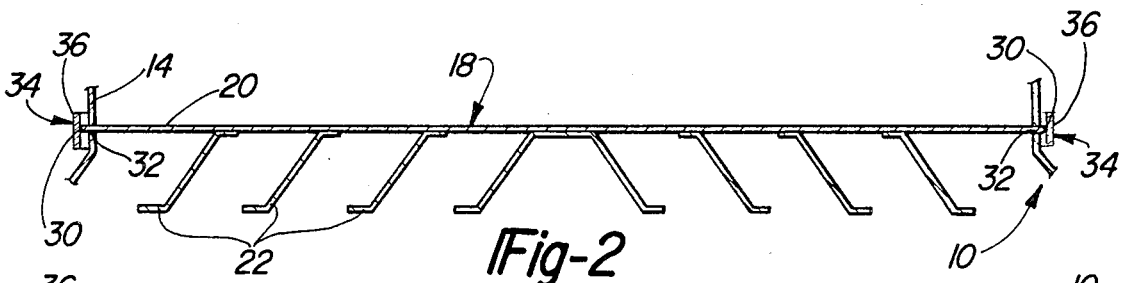
FIG. 2 is a cross-sectional view of the flush face air diffuser assembly.
Figure 3:
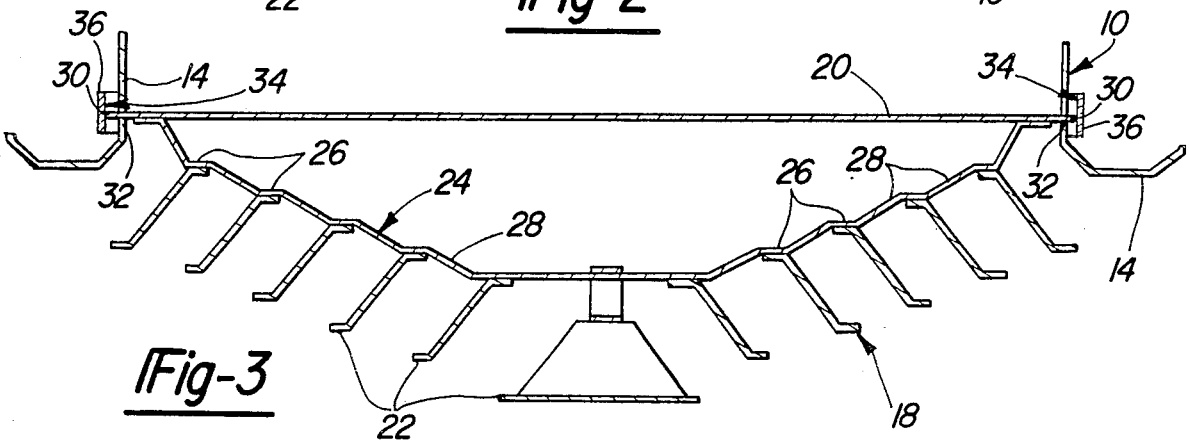
FIG. 3 is a cross-sectional view of the drop-down air diffuser assembly.

Referring first to FIGS. 1 through 3 above, there is shown an air diffuser 10 embodying the present invention. The diffuser 10 is adapted to be mounted to a ceiling structure 12 within the outlet opening of a ventilation duct in order to distribute air flow from the ventilation system efficiently through the room. Typically, two types of vane air diffusers are utilized to distribute the air flow: a drop-down diffuser as illustrated in FIGS. 1 and 3 and a flush-face diffuser as cross-sectionally illustrated in FIG. 2. While it is generally acknowledged that flush-face diffusers are more convenient because they are mounted substantially flush with the ceiling construction; the drop-down diffuser provides more efficient air flow and greater throw. However, because of the different fin cores associated with each type of diffuser, the two assemblies are not readily interchangeable according to ventilation requirements.

Referring now to FIG. 1, the air diffuser 10 comprises a frame 14 having a substantially rectangular configuration and including a plurality of mounting holes 16 utilized to secure the frame 14 to the ceiling 12 or similar structural surface. In accordance with the present invention, detachably mounted within the frame 14 is a fin core 18 which determines the configuration of the diffuser 10. In this manner, the identical frame 14 can be utilized for both the flush-face diffuser (FIG. 2) and the drop-down diffuser (FIG. 3) thereby reducing inventory costs and facilitating conversion. Oftentimes, the frame 14 includes a louver assembly (not shown) to dampen or prevent air flow through the diffuser 10. Normally, the louver assembly is secured inwardly of the diffuser fin core 18 and includes a manually operable control lever extending through the diffuser 10. Thus, the louver assembly can be utilized to control the volume of air flow while the diffuser 10 controls the direction and dispersion of air flow.

An advantageous feature of the present invention is the utilization of common components in both the flush-face diffuser and the drop-down diffuser resulting in reduced inventory and manufacturing costs. As is illustrated in FIGS. 2 and 3, both diffuser configurations utilize at least one substantially planar cross-bracket 20. Preferably, a pair of parallel bracket members 20 are utilized in order to provide added stability to the fin core 18. In the case of the flush-face diffuser, a plurality of fin elements 22 are secured directly to the planar bracket member 20. In contrast, the individual fin elements 22 of the drop-down diffuser are secured to a stepped bracket member 24 which, in turn, is secured to the planar bracket member 20. In both configurations, identical fin elements 22 are utilized thereby reducing inventory and manufacturing costs. The fin elements 22 preferably have a configuration similar to the configuration of the frame 14 and are mounted coaxially, each fin element 22 having a smaller diameter than the outwardly adjacent fin element 22. As is well known, the individual fin elements 22 are outwardly sloping such that air flow is directed outwardly along the ceiling, wall, etc.

The stepped bracket member 24 includes tiered segments 26 to which the individual fin elements 22 are secured. As is best shown in FIG. 3, opposing tiered segments 26 of the bracket member 24 are coplanar in order to support opposite sides of the individual fin elements 22. The tiered segments 26 are joined by sloped segments 28 in order to form a continuous elongate bracket member 24. Because of its uniform configuration, the length of the stepped bracket 24 may be reduced to accommodate varying diffuser sizes simply by severing the bracket at the outer end of a tiered segment 26 and attaching the depending tiered segment to a similarly downsized planar bracket member 20. As a result, the same bracket members can be utilized, by way of example, for diffusers ranging from 14" having six fin elements to 6" having two fin elements.

Figure 4:
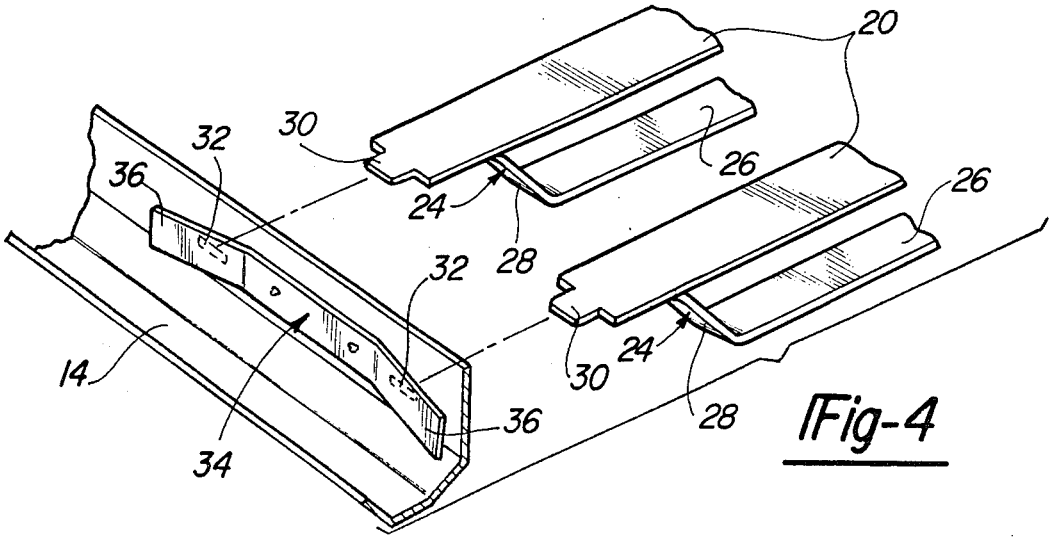
FIG. 4 is an exploded perspective view of the mounting bracket assembly of the drop-down air diffuser embodying the present invention.

Referring now to FIG. 4, the elongate mounting brackets include means for detachably mounting the fin core 18 within the frame 14. In one embodiment, the ends of the planar bracket member 20 are provided with mounting tabs 30 which are received in corresponding slots 32 formed in the side walls of the frame 14. In order to prevent inadvertent removal of the fin core 18 from within the frame 14, one side of the frame is provided with a biasing member 34 extending over the mounting slots 32. The biasing member 34 includes outer arms 36 which act against the mounting tabs 30 extending through the slots 32 to prevent longitudinal movement of the bracket. As a result, to remove the fin core 18, the brackets must be shifted against the biasing member 34 until the tabs 30 at the opposite end thereof can be removed from the corresponding slot 32. In an alternative embodiment, the planar bracket member 20 can be eliminated and mounting tabs 30 provided at the ends of the stepped bracket member 24 such that the stepped bracket can be directly detachably secured to the frame 14.

Thus, the present invention provides an economical air diffuser 10 which can be readily converted between a flush-face diffuser and a drop-down diffuser. This conversion can be conducted in the field in the case of retrofit requirements or redesign problems, or as a manufacturing and inventory cost reduction because of the number of common components utilized by both types of diffusers 10.

The foregoing detailed description has been given for clearness of understanding only and no unnecessary limitations should be understood therefrom as some modifications will be obvious to those skilled in the art without departing from the appended claims.

I claim:

1. In an air diffuser for distributing air flow from a ventilation duct and including a rectangular frame adapted to be mounted to the outlet of the ventilation duct, the improvement comprising:

a rectangular fin core detachably mounted within said frame, said fin core including at least one mounting bracket detachably engaging opposite sides of the frame and a plurality of coaxially disposed fin elements secured to said at least one mounting bracket wherein said fin elements may be secured to a substantially planar mounting bracket and a stepped mounting bracket to selectively convert the diffuser between a flush-faced diffuser and a drop-down diffuser, respectively, said planar mounting bracket and said stepped mounting bracket being interchangeable within the frame.

2. The air diffuser as defined in claim 1 wherein said planar mounting bracket and said stepped mounting bracket include mounting tabs formed at the remote ends thereof, said mounting tabs matingly received within mounting slots formed in opposite sides of said rectangular frame.

3. The air diffuser as defined in claim 2 wherein said fin elements are coaxially mounted in a pair of parallel mounting brackets secured to opposite sides of the frame, each fin element having a diameter less than the outwardly adjacent fin element, said fin elements adapted to be mounted to said planar mounting bracket and said stepped mounting bracket to selectively convert the diffuser between a flush-faced diffuser and a drop-down diffuser, respectively.

4. The air diffuser as defined in claim 3 wherein said fin elements are mounted to said planer mounting bracket in a substantially flush relationship such that said fin elements of said fin core are mounted flush with said frame.

5. The air diffuser as defined in claim 3 wherein said stepped mounting brackets have opposing coplanar tiered segments, said fin elements being individually mounted to coplanar tiered segments, said fin elements mounted to said brackets such that each fin element is disposed in non-planar relationship to an immediately adjacent fin element.

6. The air diffuser as defined in claim 3 wherein said frame includes biasing means preventing said fin core from inadvertently detaching from said frame.

7. In an air diffuser for distributing air flow from a ventilation duct and including a rectangular frame adapted to be mounted to the outlet of the ventilation duct, the improvement comprising:

a rectangular fin core detachably mounted within said frame, said fin core including a pair of parallel mounting brackets detachably engaging opposite sides of the frame and a plurality of coaxially disposed fin elements secured to said mounting brackets wherein said fin elements may be coaxially secured to a pair of planar mounting brackets and a pair of stepped mounting brackets, said fin core with said planar mounting brackets and said fin core with said stepped mounting brackets being interchangeable within the frame to selectively convert the diffuser between a flush-faced diffuser having said fin elements in flush relationship to the frame and a drop-down diffuser having each said fin element in non-planar relationship to an immediately adjacent fin element.

8. The air diffuser as defined in claim 7 wherein said mounting brackets include mounting tabs formed at the remote ends thereof, said mounting tabs being removably received within mounting slots formed in opposite sides of said frame to detachably secure said fin core within said frame.

9. The air diffuser as defined in claim 8 wherein said frame includes biasing means in conjunction with said mounting slots and adapted to act against said mounting tabs disposed within said slots thereby preventing said fin core from inadvertently detaching from said frame.

10. The air diffuser as defined in claim 9 wherein said diffuser is selectively converted between a flush-faced diffuser and a drop-down diffuser by correspondingly replacing said fin core within said frame.

* * * * *